US009048522B2

(12) United States Patent
Miyata

(10) Patent No.: US 9,048,522 B2
(45) Date of Patent: Jun. 2, 2015

(54) WAVEGUIDE TO PLANAR LINE TRANSDUCER HAVING A COUPLING HOLE WITH OPPOSITELY DIRECTED PROTUBERANCES

(75) Inventor: Akira Miyata, Tokyo (JP)

(73) Assignee: NEC CORPORATION, Tokyo (JP)

( * ) Notice: Subject to any disclaimer, the term of this patent is extended or adjusted under 35 U.S.C. 154(b) by 185 days.

(21) Appl. No.: 13/579,512

(22) PCT Filed: Feb. 10, 2011

(86) PCT No.: PCT/JP2011/052917

§ 371 (c)(1),
(2), (4) Date: Sep. 4, 2012

(87) PCT Pub. No.: WO2011/102300

PCT Pub. Date: Aug. 25, 2011

(65) Prior Publication Data

US 2012/0319796 A1 Dec. 20, 2012

(30) Foreign Application Priority Data

Feb. 17, 2010 (JP) ..... 2010-032655

(51) Int. Cl.
*H01P 5/107* (2006.01)

(52) U.S. Cl.
CPC ..... *H01P 5/107* (2013.01)

(58) Field of Classification Search
CPC ..... H01P 5/107
USPC ..... 333/26
See application file for complete search history.

(56) References Cited

U.S. PATENT DOCUMENTS 6,816,028 B2 * 11/2004 Kato ..... 333/26
2007/0182505 A1 * 8/2007 Fujita et al. ..... 333/26

FOREIGN PATENT DOCUMENTS

JP 2002-500840 A 1/2002
JP 2004104816 A 4/2004
JP 2004297465 A 10/2004

(Continued)

OTHER PUBLICATIONS

International Search Report for PCT/JP2011/052917 dated Apr. 26, 2011.

(Continued)

*Primary Examiner* — Benny Lee
(74) *Attorney, Agent, or Firm* — Sughrue Mion, PLLC

(57) ABSTRACT

A waveguide/planar line transducer of the present invention includes a waveguide that transmits electromagnetic waves through an opening portion, and a multiplayer substrate that includes a plurality of conductive layers. The multilayer substrate includes: a first conductive layer that is in close contact with the opening portion of the waveguide, and includes a first coupling hole provided at a position overlapping the opening portion of the waveguide when viewed in a plate thickness direction of the multilayer substrate; a strip electrode that is electromagnetically coupled to the first conductive layer, arranged on an opposite side to the first conductive layer in the plate thickness direction, and extending in one of a planar direction of the multilayer substrate; and a second conductive layer that is arranged between the first conductive layer and the strip conductor in the plate thickness direction, and includes a second coupling hole having a protuberance facing at least one of directions in which the strip electrode extends.

2 Claims, 7 Drawing Sheets

(56) References Cited

FOREIGN PATENT DOCUMENTS

| | | | |
|---|---|---|---|
| JP | 2007-214777 | A | 8/2007 |
| JP | 4236607 | B2 | 3/2009 |

OTHER PUBLICATIONS

Communication dated Nov. 11, 2014 from The Japanese Patent Office in counterpart Japanese Patent Application No. 2012500577.

* cited by examiner

WAVEGUIDE TO PLANAR LINE TRANSDUCER HAVING A COUPLING HOLE WITH OPPOSITELY DIRECTED PROTUBERANCES

CROSS REFERENCE TO RELATED APPLICATIONS

This application is a National Stage of International Application No. PCT/JP2011/052917, filed on Feb. 10, 2011, which claims priority from Japanese Patent Application No. 2010-032655, filed on Feb. 17, 2010, the contents of all of which are incorporated herein by reference in their entirety.

TECHNICAL FIELD

The present invention relates to a waveguide/planar line transducer that changes the line between a waveguide and a planar line.

BACKGROUND ART

Conventionally, a waveguide/planar line transducer is used as an interface portion that electromagnetically couples a waveguide and a planar transducer and that changes lines. The waveguide/planar line transducer is for example used by being attached to a circuit board. The circuit board has a planar line that amplifies and frequency converts microwaves or millimeter waves that are transmitted through a waveguide.

As an example of a circuit board that includes a waveguide/planar line transducer, Patent Document 1 (See below) discloses a circuit board that transmits high-frequency signals from a planar line (strip line) to a waveguide. The circuit board that is disclosed in Patent Document 1 has two coupling holes that are oppositely arranged between the waveguide and the planar line in a manner sandwiching a cavity and also mutually electromagnetically coupled.

According to the circuit board disclosed in Patent Document 1, since it is possible to reduce the impedance mismatch of the line that transmits the high-frequency signal by the two coupling holes, it is possible to reduce the passage loss of the high-frequency signal.

PRIOR ART DOCUMENT

Patent Document

[Patent Document 1] Japanese Patent Publication No. 4236607 (FIG. 4)

SUMMARY OF THE INVENTION

Problem to be Solved by the Invention

However, in the circuit board that is disclosed in Patent Document 1, a multilayer substrate is required in which a hollow structure is formed. Moreover, an electrode must be separately arranged for forming the coupling hole at a portion that the waveguide faces. For this reason, constituting a planar line with only an inexpensive resin substrate is difficult. In this way, there is the problem of not being able to apply low-cost materials and methods in the structure that is disclosed in Patent Document 1.

Also, in the circuit board that is disclosed in Patent Document 1, the side ground pattern and the ground via that are provided in the multilayer substrate are both buried vias.

By adopting through vias instead of buried vias, forming a circuit board at an even lower cost is conceivable. However, in this case, electromagnetic waves change the lines between the waveguide and the planar line, and a portion of the electric field of the electromagnetic waves enters between mutually parallel electrode layers between the strip electrode and the coupling holes.

Mutually parallel electrode layers act as parallel planar lines. For this reason, the electric field that enters between these electrode layers ends up advancing through the electrode layers of the multilayer substrate, and there is a risk of a loss occurring due to passage between the waveguide and the planar line.

The present invention has been achieved in view of the above circumstances, and one exemplary object thereof is to provide a waveguide/planar line transducer that is inexpensive and is capable of reducing loss due to passage between the waveguide and planar line.

Means for Solving the Problem

In order to solve the aforementioned issues, the present invention provides the following means.

A waveguide/planar line transducer of the present invention includes a waveguide that transmits electromagnetic waves through an opening portion, and a multilayer substrate that includes a plurality of conductive layers. The multilayer substrate includes: a first conductive layer that is in close contact with the opening portion of the waveguide, the first conductive layer including a first coupling hole provided at a position overlapping the opening portion of the waveguide when viewed in a plate thickness direction of the multilayer substrate; a strip electrode that is electromagnetically coupled to the first conductive layer, the strip electrode arranged on an opposite side to the first conductive layer in the plate thickness direction, and the strip electrode extending in one of a planar direction of the multilayer substrate; and a second conductive layer that is arranged between the first conductive layer and the strip conductor in the plate thickness direction, and the second conductive layer including a second coupling hole having a protuberance facing at least one of directions in which the strip electrode extends.

Effect of the Invention

According to the waveguide/planar line transducer of the present invention, it is possible to reduce the passage loss of electromagnetic waves due to electromagnetic waves that have passed the first conductive layer being blocked by the second conductive layer. As a result, it is possible to provide a waveguide/planar line transducer that is inexpensive and with a small passage loss.

DETAILED DESCRIPTION OF EXEMPLARY EMBODIMENTS

Figure 1:
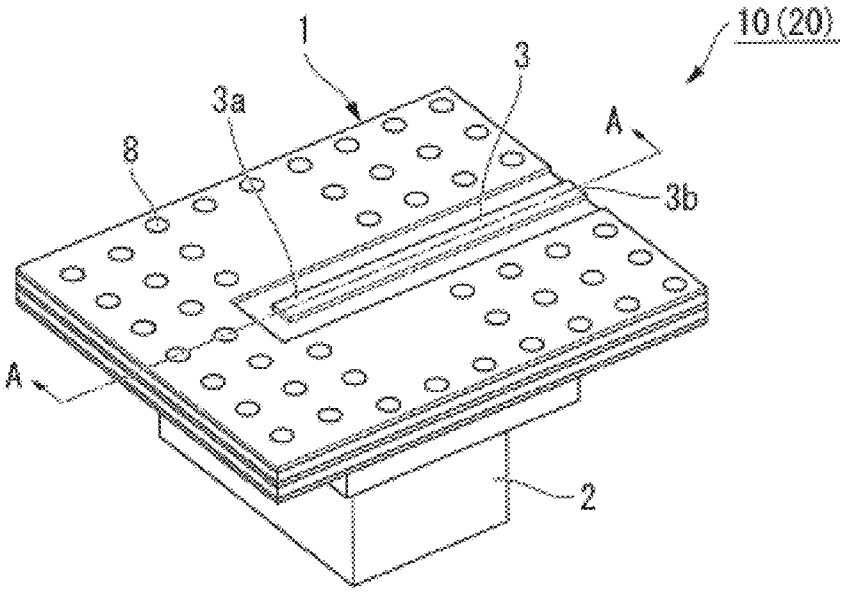
FIG. 1 is a perspective view that shows a waveguide/planar line transducer of a first exemplary embodiment of the present invention.

Throughout the drawings and the detailed description, unless otherwise described or provided, the same drawing reference numerals will be understood to refer to the same elements, features, and structures.

First Exemplary Embodiment

Figure 2:
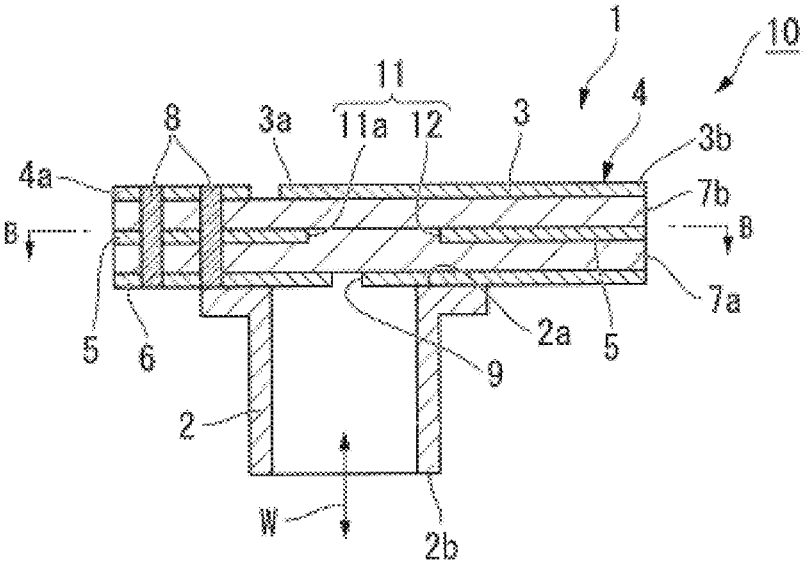
FIG. 2 is a cross-sectional view taken along line A-A of FIG. 1.
Figure 3:
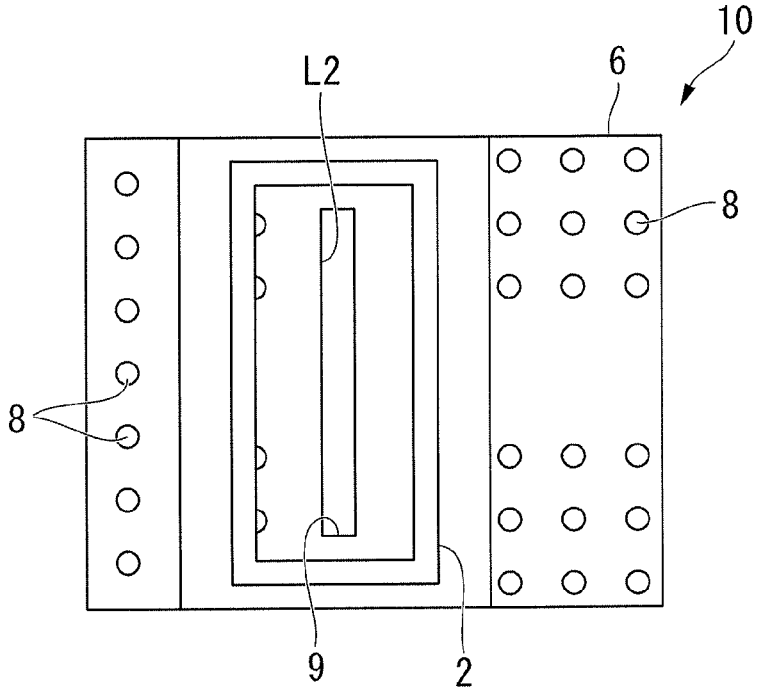
FIG. 3 is a bottom view of the waveguide/planar line transducer shown in FIG. 1.
Figure 4:
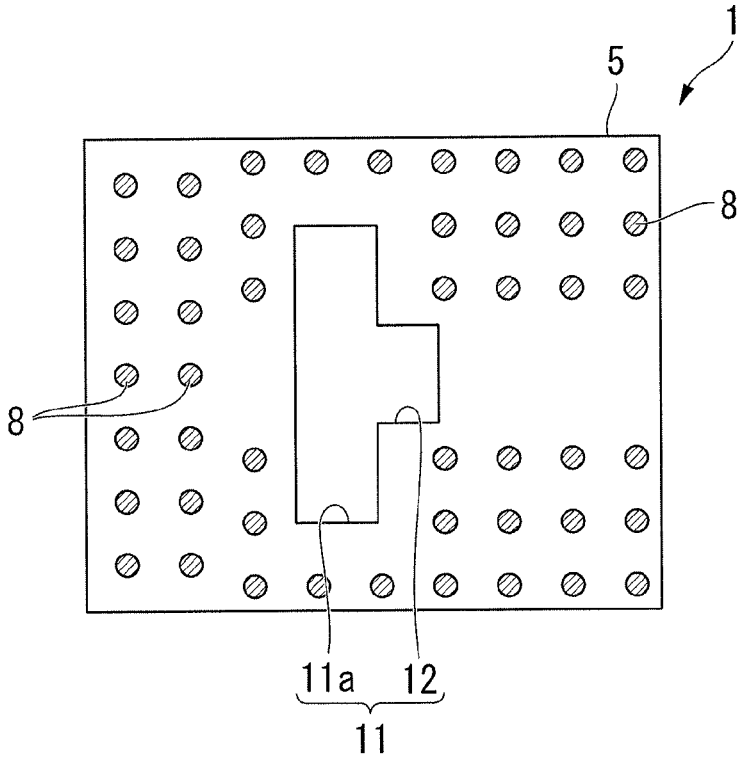
FIG. 4 is a cross-sectional view taken along line B-B of FIG. 2.
Figure 5:
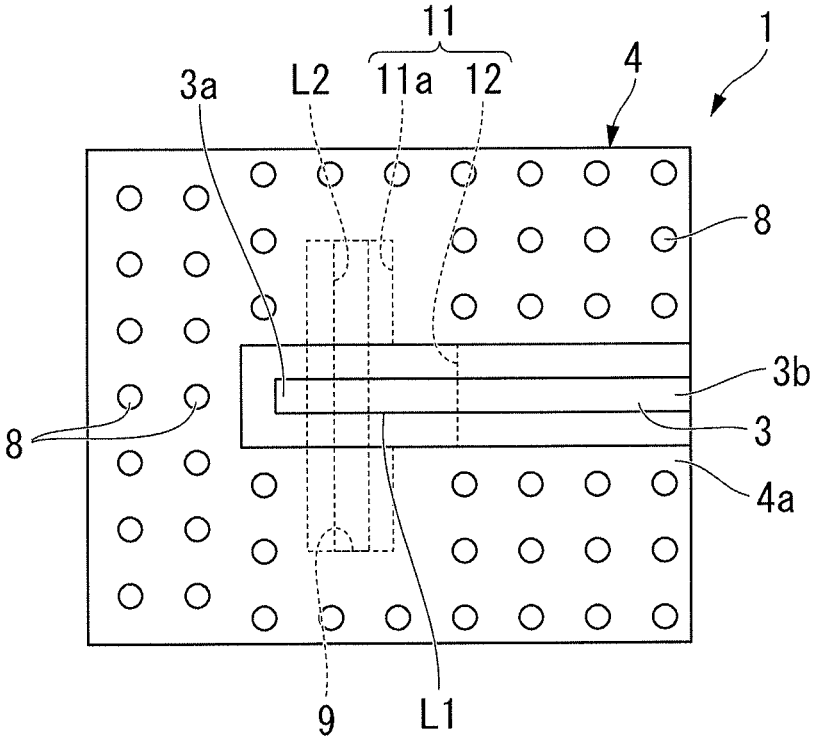
FIG. 5 is a plan view of the waveguide/planar line transducer shown in FIG. 1.

A waveguide/planar line transducer 10 of a first exemplary embodiment of the present invention shall be described with reference to the drawings. FIG. 1 is a perspective view that shows the waveguide/planar line transducer 10. Also, FIG. 2 is a cross-sectional view taken along line A-A of FIG. 1. FIG. 3 is a 5 bottom view of the waveguide/planar line transducer 10. FIG. 4 is a cross-sectional view taken along line B-B of FIG. 2. FIG. 5 is a plan view of the waveguide/planar line transducer 10.

As shown in FIG. 1 and FIG. 2, the waveguide/planar line transducer 10 includes a multilayer substrate 1 and a waveguide 2. The multilayer substrate 1 is plate-shaped, and the waveguide 2 is connected one surface in the plate thickness direction.

Hereinbelow, the description shall be given, with the side at which the waveguide 2 is connected in the plate thickness direction of the multilayer substrate 1 being the lower side, and the side opposite the side at which the waveguide 2 is connected in the plate thickness direction of the multilayer substrate 1 being the upper side.

As shown in FIG. 2 and FIG. 3, the waveguide 2 transmits electromagnetic waves W (FIG. 2). In the present exemplary embodiment, the waveguide 2 is a cylindrical, hollow waveguide that transmits microwaves. Also, the waveguide 2 is a rectangular waveguide in which the cross-sectional shape that is perpendicular to the axial direction is formed in a rectangular shape.

As shown in FIG. 2, a flange-shaped opening portion 2*a* that has an opening that is connected to the multilayer substrate 1 is formed at one end of the waveguide 2 in the axial direction. An incoming/outgoing portion 2*b* at which electromagnetic waves W are incoming or outgoing is formed at the other end of the waveguide 2 in the axial direction. As the material of the waveguide 2, for example it is possible to adopt a metal material such as copper or aluminum. With regard to the internal shape of the waveguide 2, for example, the vertical dimensions and horizontal dimensions are suitably determined in the cross section perpendicular to the axial direction, in correspondence with the frequency of the electromagnetic waves W that are transmitted by the waveguide 2.

The multilayer substrate 1 is a dielectric multilayer substrate in which dielectric layers 7*a* and 7*b* are laminated. In the multilayer substrate 1, a lower layer electrode (first conductive layer) 6, the dielectric layer 7*a*, an inner layer electrode (second conductive layer) 5, the dielectric layer 7*b*, and an upper layer electrode 4 are laminated in that order from the lower side to the upper side. Moreover, the multilayer substrate 1 has a plurality of through vias 8 that are electrically connected with each of the lower layer electrode 6, the inner layer electrode 5, and the upper layer electrode 4. In the present exemplary embodiment, the multilayer substrate 1 is formed in a rectangular shape (refer to FIG. 1).

As shown in FIG. 2 and FIG. 3, the lower layer electrode 6 is a conductive layer that is formed in a manner extending in the planar direction of the multilayer substrate 1. In the present exemplary embodiment, the lower layer electrode 6 is formed by copper. A first coupling hole 9 that penetrates the lower layer electrode 6 in the thickness direction is formed in the lower layer electrode 6.

The first coupling hole 9 is a hole that is electromagnetically coupled with the waveguide 2, and is a hole that is formed in the lower layer electrode 6 in order to transmit electromagnetic waves W from the waveguide 2 to the dielectric layer 7*a* (FIG. 2). The shape of the first coupling hole 9 is a shape that can excite the electromagnetic waves W that pass through the first coupling hole 9. In the present exemplary embodiment, with regard to the shape of the first coupling hole 9, the contour shape has an oblong shape when viewed in the thickness direction of the multilayer substrate 1 (FIG. 2).

The lower layer electrode 6 is fixed in close contact with the opening portion 2*a* of the waveguide 2. The position at which the opening portion 2*a* (FIG. 2) of the waveguide 2 is in close contact with the lower layer electrode 6 is the position at which, when viewed in the plate thickness direction of the multilayer substrate 1, the first coupling hole 9 is contained to the inner side of the opening portion 2*a* (FIG. 2) of the waveguide 2.

In the present exemplary embodiment, the lower layer electrode 6 and the waveguide 2 are fixed to the multilayer substrate 1 with screws that are not illustrated. The attachment of the lower layer electrode 6 and the waveguide 2 is not restricted to fastening screws. For example, the lower layer electrode 6 and the waveguide 2 may be bonded with an adhesive. Also, by performing through-hole plating on the inner surface of the through hole that is formed in the substrate (motherboard), the waveguide 2 may be formed. In this case, the motherboard in which the waveguide 2 is formed and the lower layer electrode 6 may be connected by surface mounting with solder.

As shown in FIG. 2, the dielectric layer 7*a* is a layer of a dielectric body prepared between the lower layer electrode 6 and the inner layer electrode 5. In the present exemplary embodiment, the material of the dielectric layer 7*a* is an organic material such as glass epoxy or ceramic. The material of the dielectric layer 7*a* is not limited to glass epoxy or ceramic.

As shown in FIG. 2 and FIG. 4, the inner layer electrode 5 is a conductive layer that is formed in an extended manner in the planar direction of the multilayer substrate 1 (FIG. 2). The inner layer electrode 5 has a second coupling hole 11 that is formed in a manner penetrating in the thickness direction.

The second coupling hole 11 is a hole that is electromagnetically coupled with the first coupling hole 9. The shape of the second coupling hole 11 shall be discussed later.

As shown in FIG. 2, the dielectric layer 7*b* is a layer of a dielectric body that is provided between the inner layer electrode 5 and the upper layer electrode 4. The material of the dielectric layer 7*b* is an organic material such as glass epoxy or ceramic similarly to the dielectric layer 7*a*. The material of the dielectric layer 7*b* is not limited to glass epoxy or ceramic. The dielectric layer 7*a* and the dielectric layer 7*b* may be formed with differing materials.

As shown in FIG. 5, the upper layer electrode 4 has a strip electrode (planar line) 3 and a ground electrode 4*a*. The strip electrode 3 is formed extending in a direction perpendicular with the direction of the long side L2 of the first coupling hole 9 when viewed in the thickness direction of the multilayer substrate 1. The ground electrode 4*a* is provided with a gap opened along the outer periphery of the strip electrode 3 in the planar direction of the multilayer substrate 1.

The strip electrode 3 is an electrode that is electromagnetically coupled with the second coupling hole 11 (refer to FIG. 2).

As shown in FIG. 5, the shape of the strip electrode 3 is a rectangular shape in which the long side L1 of the strip electrode 3 and the long side L2 of the first coupling hole 9 are perpendicular when viewed in the thickness direction of the multilayer substrate 1. The strip electrode 3 is arranged so that the first coupling hole 9 and the second coupling hole 11 are positioned between a distal end 3*a* and a base end 3*b* when viewed in the thickness direction of the multilayer substrate 1. A signal line, not illustrated, is connectable to the base end 3*b* of the strip electrode 3. The planar line is formed at the upper layer electrode 4 by the strip electrode 3.

As shown in FIG. 2 and FIG. 5, the ground electrode 4*a* is electrically connected to the through hole vias 8. The ground electrode 4*a* is formed parallel with the surface of the lower layer electrode 6 (FIG. 2).

As shown in FIG. 2, the through hole vias 8 are provided in order to make the ground potential of the ground electrode 4*a* of the upper layer electrode 4, the inner layer electrode 5, and the lower layer electrode 6 equivalent. The through hole vias 8 are disposed in gridlike fashion at positions that do not overlap with the strip electrode 3, the second coupling hole 11 and the first coupling hole 9, when viewed in the thickness direction of the multilayer substrate 1 (refer to FIG. 3 to FIG. 5). The material of the through hole vias 8 is copper, the same as the upper layer electrode 4, the inner layer electrode 5, and the lower layer electrode 6. This is in order to enable the formation of the through hole vias 8 in the formation process of the upper layer electrode 4, the inner layer electrode 5, and the lower layer electrode 6 during the manufacture of the multilayer substrate 1.

Next, the shape of the second coupling hole 11 that is formed in the inner layer electrode 5 shall be described.

As shown in FIG. 4, the second coupling hole 11 has a rectangular portion 11*a* and a protuberance 12. The rectangular portion 11*a* has a shape that extends parallel with the direction of the long side L2 of the first coupling hole 9 (refer to FIG. 3), when viewed in the thickness direction of the multilayer substrate 1. The protuberance 12 has a shape that projects to the base end 3*b* side of the strip electrode 3 in the direction of the long side L1 of the strip electrode 3 (refer to FIG. 5), when viewed in the thickness direction of the multilayer substrate 1. In the present exemplary embodiment, the shape of the protuberance 12 is a rectangular shape when viewed in the thickness direction of the multilayer substrate 1. Also, the second coupling hole 11 has an approximate T shape when viewed in the thickness direction of the multilayer substrate 1.

The second coupling hole 11 is arranged so that, when viewed in the thickness direction of the multilayer substrate 1, the contour line thereof is positioned with a gap opened around the outer periphery of the first coupling hole 9 (FIG. 2).

The action of the waveguide/planar line transducer 10 of the constitution described above shall be described referring to FIG. 6A and FIG. 6B.

Figure 6A:
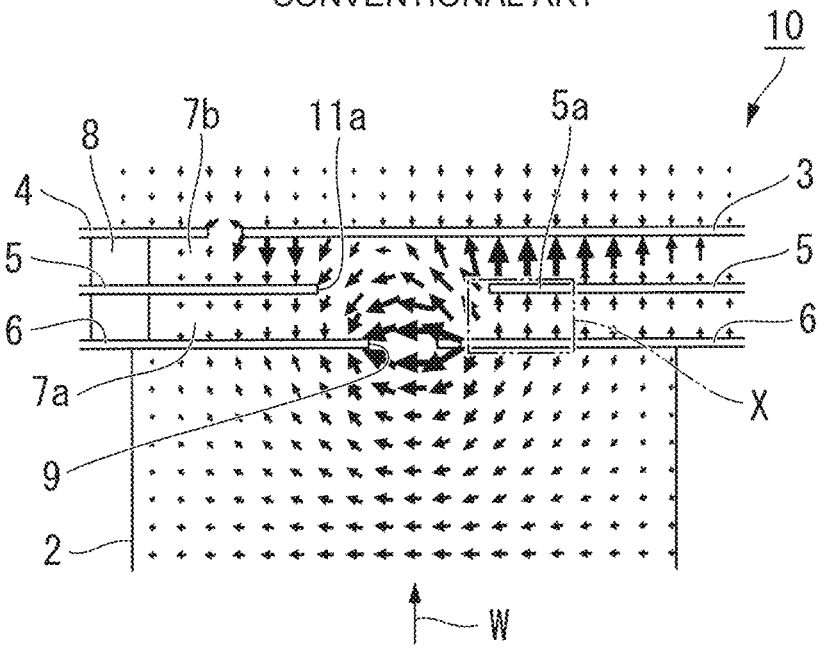
FIG. 6A CONVENTIONAL ART
FIG. 6A is a schematic diagram that shows the instantaneous value of the distribution of the electric field in a waveguide/planar line transducer of the comparative example.
Figure 6B:
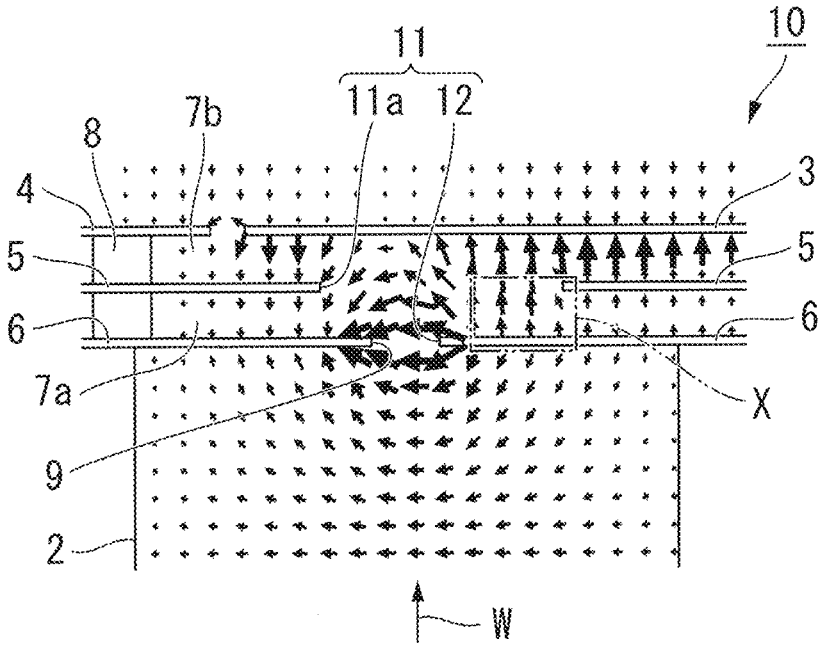
FIG. 6B is a schematic diagram that shows the instantaneous value of the distribution of the electric field in the waveguide/planar line transducer of the present exemplary embodiment.

FIG. 6A is a schematic diagram that shows the instantaneous value of the distribution of the electric field in a waveguide/planar line transducer 10 (comparative example) that does not have protuberance 12. FIG. 6B is a schematic diagram that shows the instantaneous value of the distribution of the electric field during use of the waveguide/planar line transducer 10. In FIG. 6A and FIG. 6B, the size of the arrows shows the size of the electric field intensity, and the direction of the arrows shows the orientation of the electric field.

In the present exemplary embodiment, an electromagnetic field simulation was performed under the following circumstances. As the electromagnetic wave W, an electromagnetic wave with a frequency of 77 GHz was used. As the waveguide 2, a waveguide that transmits electromagnetic waves in the W band (75 GHz to 110 GHz) was used. The substrate thickness of the multilayer substrate 1 is 130 μm. The dielectric constant of the dielectric layers 7*a* and 7*b* was set to 3.5. The electromagnetic waves W were made incident on the incoming/outgoing portion 2*b* (FIG. 2) of the waveguide 2.

The constitution of the comparative example differs from the constitution of the present exemplary embodiment on the points of: the protuberance 12 not being formed; a conductive layer 5*a* being provided; and only the rectangular portion 11*b* being formed.

As shown in FIG. 6B, when the electromagnetic wave W is incident on the waveguide 2, the electromagnetic wave W propagates through the interior of the waveguide 2 to the first coupling hole 9. Then, the electromagnetic wave W is excited by the first coupling hole 9 that is electromagnetically coupled with the waveguide 2, and is transmitted through the first coupling hole 9 to the dielectric layer 7*a*. In the dielectric layer 7*a*, the electromagnetic wave W propagates toward the strip electrode 3 side, and is transmitted to the dielectric layer 7*b* by being excited by the second coupling hole 11. The electromagnetic wave W that is transmitted to the dielectric layer 7*b* propagates from the dielectric layer 7*b* to the strip electrode 3.

The electromagnetic wave W that is transmitted through the first coupling hole 9 exists between the protuberance 12 and the lower layer electrode 6 (the region X shown in FIG. 6B). This electromagnetic wave W is transmitted through the protuberance 12 to the upper layer electrode side 4.

Conventionally, as shown for example in FIG. 6A, a conductive layer (the conductive layer 5*a* shown in FIG. 6A) that comes between the region X and the upper layer electrode 4 is arranged between the lower layer electrode 6 and the upper layer electrode 4. In this case, between the strip electrode 3 and the first coupling hole 9, a state arises in which a portion of the electric field that is transmitted to the strip electrode 3 enters between the lower layer electrode 6 and the upper layer electrode 4 that are mutually parallel. The electric field that is sandwiched by the lower layer electrode 6 and the upper layer electrode 4 advances along the dielectric layer 7*a* of the multilayer substrate 1 in the manner of a parallel flat-plate line. For that reason, it becomes a passage loss without being used for conversion of the line between the waveguide 2 and the strip electrode 3.

In contrast to this, as shown in FIG. 6B, in the present exemplary embodiment, the protuberance 12 is formed in a shape in which the inner layer electrode 5 is lengthily cut out in the direction of the long side L1 of the strip electrode 3 (refer to FIG. 5). For that reason, the electric field strength of the electromagnetic wave W that is transmitted from the lower layer electrode 6 to the strip electrode 3 is large compared to the case where the protuberance 12 is not formed. That is to say, among the electromagnetic waves W that are incident on the waveguide 2, the component that reaches the strip electrode 3 increases. In this manner, the passage loss of the electromagnetic waves W when performing line conversion from the waveguide 2 to the strip electrode 3 is reduced by the formation of the protuberance 12.

As described above, according to the waveguide/planar line transducer 10 of the present exemplary embodiment, the second coupling hole 11, which has the protuberance 12 that protrudes toward the base end 3*b* side in the long side L1 direction of the strip electrode 3, is formed in the inner layer electrode 5. With this constitution, it is possible to reduce the passage loss of electromagnetic waves in the waveguide/planar line transducer 10. Accordingly, it is possible to provide the waveguide/planar line transducer which can be manufactured inexpensively using a dielectric multilayer substrate, and has a small passage loss of electromagnetic waves.

Moreover, according to the present constitution, even if an inexpensive substrate construction method is used that employs through hole vias 8 in which the interval between the coupling hole electrode ends of the inner layer electrode 5 and the through hole vias is wider than the case of using buried vias, it is possible to reduce the component of the electric field that is sandwiched between the upper layer electrode 4 and the lower layer electrode 6. Thereby, it is possible to provide a low-cost waveguide/planar line transducer using inexpensive materials such as a resin substrate or inexpensive methods.

Second Exemplary Embodiment

Next, a waveguide/planar line transducer 20 of a second exemplary embodiment of the present invention shall be described with reference to FIG. 7 and FIG. 8.

Figure 7:
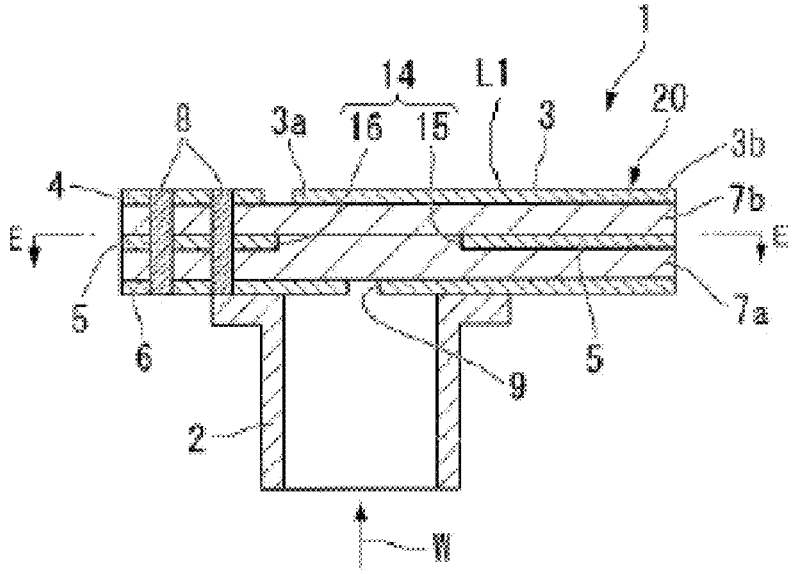
FIG. 7 is a diagram that shows a waveguide/planar line transducer of a second exemplary embodiment of the present invention, being a cross-sectional view taken along line A-A of FIG. 1.

FIG. 7 is a diagram that shows the waveguide/planar line transducer 20 of the present exemplary embodiment, being a cross-sectional view taken along line A-A of FIG. 1. FIG. 8 is a cross-sectional view taken along line E-E of FIG. 7.

Figure 8:
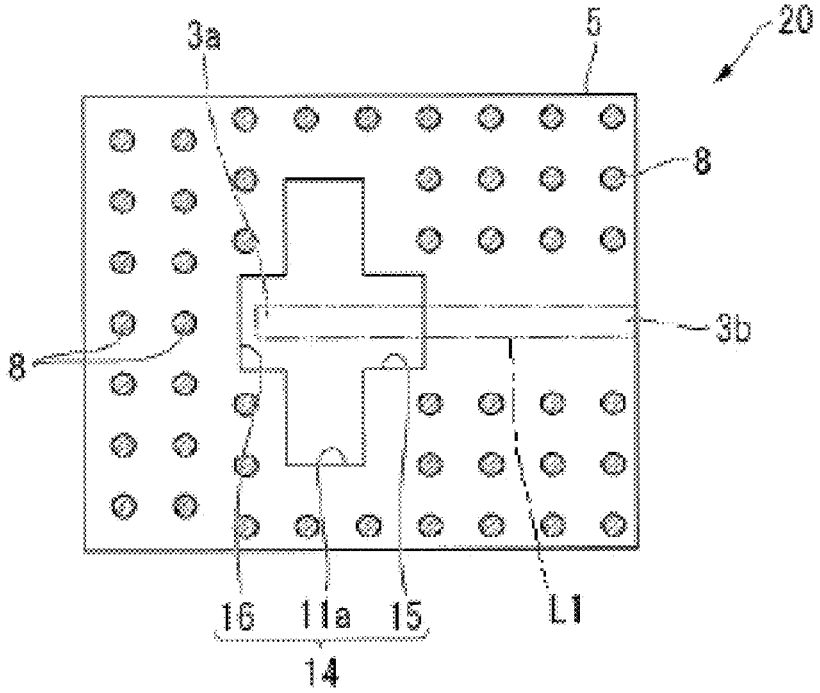
FIG. 8 is a cross-sectional view taken along line E-E of FIG. 7.

As shown in FIG. 7 and FIG. 8, the waveguide/planar line transducer 20 of the present exemplary embodiment differs from the first exemplary embodiment on the point of a second coupling hole 14 being formed in the inner layer electrode 5 instead of the second coupling hole 11 described in the first exemplary embodiment.

The second coupling hole 14 is a hole that has protuberances 15 and 16 that are respectively oriented in directions along the long side L1 direction of the strip electrode 3 (FIG. 7). In the present exemplary embodiment, the protuberance 15 is pointed to the base end 3*b* side of the strip electrode 3. Also, the protuberance 16 is pointed in the direction facing from the base end 3*b* side to the distal end 3*a* side of the strip electrode 3. That is to say, the second coupling hole 14 has a cross shape in which the axis along the long side L1 direction of the strip electrode 3 in the upper layer electrode 4 (refer to FIG. 5) and the axis along the long side L2 of the first coupling hole 9 in the lower layer electrode 6 (refer to FIG. 3) are perpendicular.

Also, the second coupling hole 14 is arranged so that the protuberances 15 and 16 are positioned between the distal end 3*a* and the base end 3*b* of the strip electrode 3, when viewed in the plate thickness direction of the multilayer substrate 1.

With the waveguide/planar line transducer 20 of the present exemplary embodiment, it is possible to exhibit the same effect as the waveguide/planar line transducer 10 of the first exemplary embodiment. Moreover, in the present exemplary embodiment, in addition to the protuberance 15 that is pointed to the base end 3*b* side of the strip electrode 3, the inner layer electrode 5 that blocks the propagation of electromagnetic waves W (FIG. 7) has the protuberance 16 that is cut out on the distal end 3*a* side of the strip electrode 3. With this constitution, it is possible to further lower the passage loss of the electromagnetic waves W.

Third Exemplary Embodiment

Figure 9:
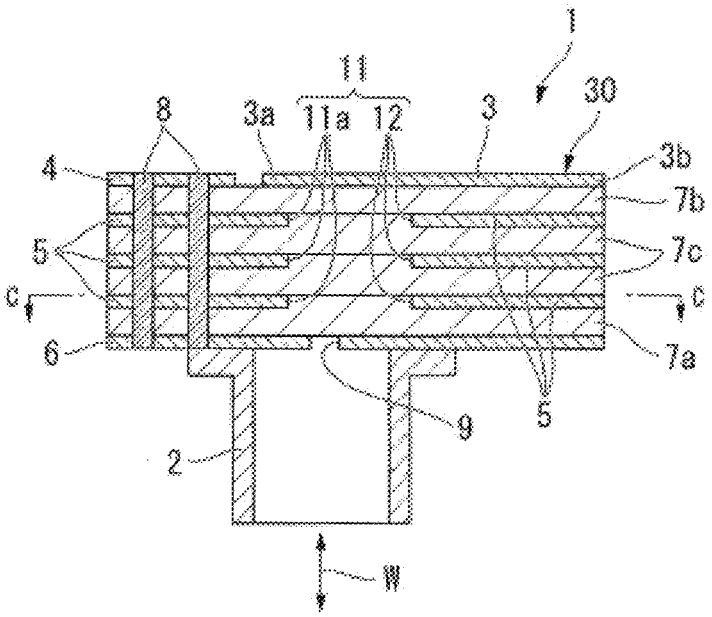
FIG. 9 is a diagram that shows the constitution of a waveguide/planar line transducer of a third exemplary embodiment of the present invention, being a cross-sectional view taken along line A-A of FIG. 1.

Next, a waveguide/planar line transducer 30 of a third exemplary embodiment of the present invention shall be described with reference to FIG. 9. FIG. 9 is a diagram that shows the waveguide/planar line transducer 30 of the third exemplary embodiment, being a cross-sectional view taken along line A-A of FIG. 1.

As shown in FIG. 9, the configuration of the waveguide/planar line transducer 30 of the third exemplary embodiment differs from the waveguide/planar line transducer 10 of the first exemplary embodiment on the point of the multilayer substrate 1 including two more inner layer electrodes 5, and dielectric layers 7*c* being further provided between those inner layer electrodes 5.

In all of the plurality of inner layer electrodes 5, the same second coupling holes 11 as the first exemplary embodiment are formed. Thereby, in the present exemplary embodiment, three of the second coupling holes 11 are formed. The three second coupling holes 11 are provided at mutually overlapping positions when viewed in the plate thickness direction of the multilayer substrate 1.

According to the waveguide/planar line transducer 30 of the present exemplary embodiment, it is possible for the multilayer substrate 1 to include a plurality of inner layer electrodes 5. As a result, it is possible to lower the passage loss of electromagnetic waves W in the same manner as the first exemplary embodiment even in the multilayer substrate 1 that has a more complicated circuit.

Modification Examples

Figure 10A:
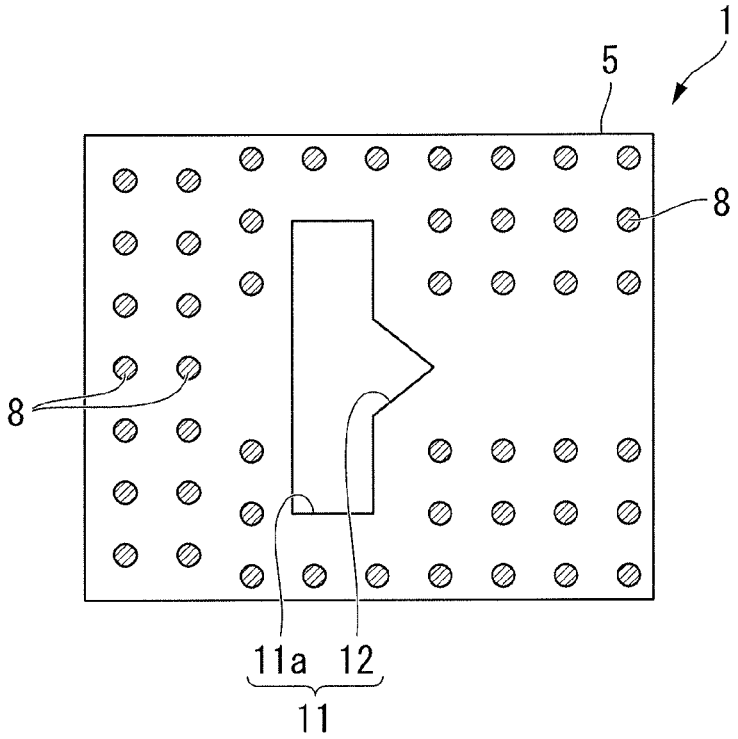
FIG. 10A is a diagram that shows the constitution of a modification example of a waveguide/planar line transducer of each exemplary embodiment of the present invention, being a cross-sectional view taken along line B-B of FIG. 1.
Figure 10B:
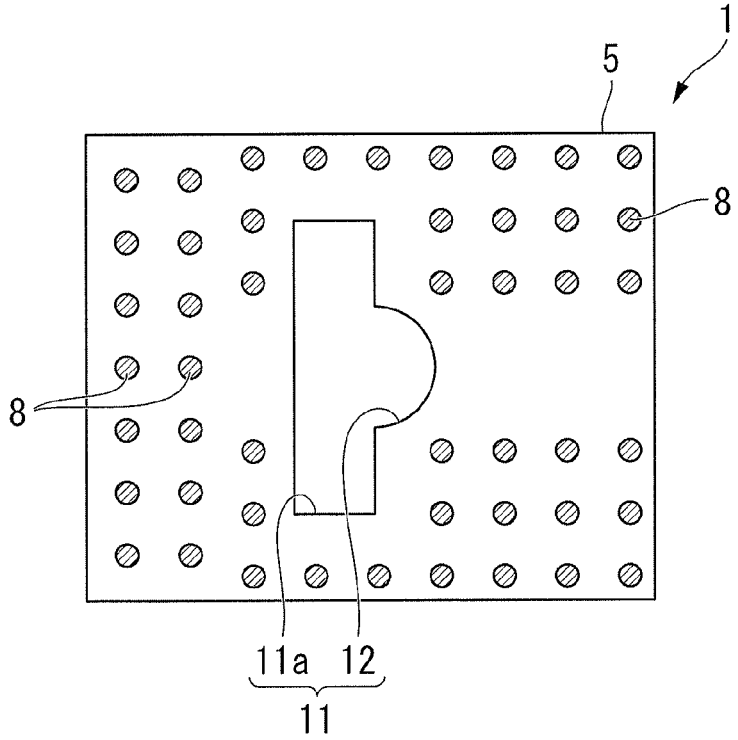
FIG. 10B is a diagram that shows the constitution of a modification example of a waveguide/planar line transducer of each exemplary embodiment of the present invention, being a cross-sectional view taken along line B-B of FIG. 1.

Hereinbelow, modification examples of the waveguide/planar line transducers 10, 20, and 30 of the exemplary embodiments described above shall be described. FIG. 10A and FIG. 10B are diagrams that show the constitutions of modification examples of the waveguide/planar line transducers of the first exemplary embodiment to the third exemplary embodiment. FIG. 10A and FIG. 10B are cross-sectional views taken along line B-B of FIG. 1 or line C-C of FIG. 9.

As shown in FIG. 10A, the contour line of the protuberance 12 may have a triangular shape when viewed in the thickness direction of the inner layer electrode 5. Also, as shown in FIG. 10B, the contour shape of the protuberance 12 may have a circular shape.

In addition, the shape of the protuberance 12 can be made to have a shape in accordance with the profile of the intensity of the electric field by the electromagnetic waves W. By forming the protuberance 12 in a shape that extends to the location where a strong electric field occurs, it is possible to reduce the passage loss of the electromagnetic waves W in the waveguide/planar line transducers. Regarding the shapes of these protuberances 12, it is possible to make the same constitution in the protuberances 15 and 16 of the second exemplary embodiment.

Hereinabove, the exemplary embodiments of the present invention have been described in detail with reference to the drawings, but specific constitutions are not limited to these exemplary embodiments, and design modifications are possible in a range that does not depart from the scope of the present invention.

For example, in each of the aforementioned exemplary embodiments, an example is described of the waveguide 2 being a rectangular waveguide, but the waveguide 2 is not limited to a rectangular waveguide. For example, the waveguide 2 may be a round waveguide. Also, as the waveguide 2, it is possible to adopt a waveguide that is capable of suitably transmitting millimeter waves. Also, a dielectric body may be arranged in the interior of the waveguide 2.

Also, the aforementioned exemplary embodiments shows examples of the lower layer electrode 6, the inner layer electrode 5, the upper layer electrode 4, the strip electrode 3, and the through hole vias 8 all being formed by copper, but they are not limited thereto. The lower layer electrode 6, the inner layer electrode 5, the upper layer electrode 4, the strip electrode 3, and the through hole vias 8 may be formed with a material other than copper. Also, the materials of the lower layer electrode 6, the inner layer electrode 5, the upper layer electrode 4, the strip electrode 3, and the through hole vias 8 may each differ.

Also, in the plurality of inner layer electrodes 5 in the third exemplary embodiment described above, an example is shown in which the same second coupling hole 11 as the first exemplary embodiment is formed, but it is not limited thereto. In the plurality of inner layer electrodes 5 in the third exemplary embodiment, the second coupling hole 14 that is described in the second exemplary embodiment may be formed in the plurality of inner layer electrodes 5.

Also, there is no need for the shapes of each of the inner layer electrodes 5 described in the third exemplary embodiment to be exactly the same.

Also, in the third exemplary embodiment described above, the constitution is illustrated of the inner layer electrode 5 being three layers, but the inner layer electrode may be two layers or four or more layers.

This application is based upon and claims the benefit of priority from Japanese patent application No. 2010-032655, filed Feb. 17, 2010, the disclosure of which is incorporated herein in its entirety by reference.

INDUSTRIAL APPLICABILITY

The present invention can be applied to a waveguide/planar line transducer. With this waveguide/planar line transducer, it is inexpensive and the passage loss is small.

DESCRIPTION OF REFERENCE SYMBOLS

10, 20, 30 Waveguide/planar line transducer
1 Multilayer substrate
2 Waveguide
3 Strip electrode
4 Upper layer electrode
5 Inner layer electrode (second conductive layer)
6 Lower layer electrode (first conductive layer)
7*a*, 7*b*, 7*c* Dielectric layer
8 Through hole via
9 First coupling hole
11, 14 Second coupling hole
12, 15, 16 Protuberance

The invention claimed is:

1. A waveguide/planar line transducer comprising a waveguide that transmits electromagnetic waves through an opening portion, and a multilayer substrate that includes a plurality of conductive layers, the multilayer substrate comprising:

a first conductive layer that is in close contact with the opening portion of the waveguide, the first conductive layer including a first coupling hole provided at a position overlapping the opening portion of the waveguide when viewed in a first direction perpendicular to the first conductive layer;

a strip electrode that is electromagnetically coupled to the first conductive layer, the strip electrode arranged on an opposite side to the waveguide with respect to the first conductive layer in the first direction, and the strip electrode extending in a second direction parallel with the first conductive layer; and a second conductive layer that is arranged between the first conductive layer and the strip conductor in the first direction, the second conductive layer including a second coupling hole, the second coupling hole having a first protuberance and a second protuberance, the first protuberance extending in the second direction, the second protuberance extending in a direction opposite to the second direction.

2. The waveguide/planar line transducer according to claim 1, wherein the multilayer substrate comprises three or more conductive layers.

* * * * *